United States Patent [19]

Gössler et al.

[11] 4,380,116

[45] Apr. 19, 1983

[54] RADIANT ELECTRICAL HEATER, AS WELL AS METHOD AND APPARATUS FOR THE MANUFACTURE THEREOF

[75] Inventors: Gerhard Gössler, Oberderdingen; Eugen Wilde, Knittlingen, both of Fed. Rep. of Germany

[73] Assignee: E.G.O. Elektro-Geräte Blanc u. Fischer, Oberderdingen, Fed. Rep. of Germany

[21] Appl. No.: 212,802

[22] Filed: Dec. 4, 1980

[30] Foreign Application Priority Data

Dec. 14, 1979 [DE] Fed. Rep. of Germany ..... 2950302

[51] Int. Cl.[3] ..... H05B 3/00

[52] U.S. Cl. ..... 29/611; 29/832; 29/835; 29/844; 219/457; 338/311

[58] Field of Search ..... 29/611, 831, 832, 835, 29/844, 845; 219/345, 357, 457, 464, 467, 542; 338/286, 293, 305, 311, 285

[56] References Cited

U.S. PATENT DOCUMENTS

| | | | |
|---|---|---|---|
| 3,303,324 | 2/1967 | Appleman | 338/311 |
| 3,436,816 | 4/1969 | Lemelson | 29/611 |
| 4,045,653 | 8/1977 | Sogren | 29/611 |
| 4,106,179 | 8/1978 | Bleckmann | 29/611 |

FOREIGN PATENT DOCUMENTS

| | | |
|---|---|---|
| 1127512 | 4/1962 | Fed. Rep. of Germany . |
| 2042427 | 3/1972 | Fed. Rep. of Germany . |
| 2202499 | 8/1972 | Fed. Rep. of Germany . |
| 106522 | 6/1974 | Fed. Rep. of Germany . |
| 2500586 | 7/1976 | Fed. Rep. of Germany . |
| 2729087 | 1/1978 | Fed. Rep. of Germany . |
| 2812247 | 9/1979 | Fed. Rep. of Germany . |

*Primary Examiner*—Leon Gilden

*Attorney, Agent, or Firm*—Steele, Gould & Fried

[57] ABSTRACT

A method for the manufacture of a radiant electrical heater, intended more particularly for heating glass ceramic hotplates, comprises so inserting or pressing helical heating resistors in helical slots in a support, such that the support or the heater coils themselves are deformed and consequently fixed to the support. The coils penetrate the wall or bottom areas of the slot or are otherwise secured by parts of the support by positive engagement. An apparatus for performing the method has a tool with ribs which deforms the support or heater coils for positive engagement.

A radiant heater is obtained, whose support has partly overlapping deformations in the slot area of the heater coils.

9 Claims, 9 Drawing Figures

RADIANT ELECTRICAL HEATER, AS WELL AS METHOD AND APPARATUS FOR THE MANUFACTURE THEREOF

The invention relates to a radiant electrical heater, particularly for glass ceramic plates with a supporting member made from an electrically and thermally insulating material with slots in which are placed helical heating resistors.

It is always a problem with such radiant heaters to fix the heater coils in the slots in such a way that they are secured in a completely satisfactory manner during the transportation and use of the radiant heater. It is important to ensure that the coils are not only secured against dropping out, but also that there is no tendency towards the longitudinal displacement (creep) of coils in the slots. The tendency towards creep is exacerbated by thermal movements during heating and cooling, as a result of which certain parts of the coils move closer together, whereas others move further apart. This leads to greater heating in the higher density areas, resulting in premature failure of the heating resistor.

Hitherto, such heater coils have been fixed in the slots by heat-resistant cement or putty. If it was desired to shape the slots in such a way that at the time of manufacture of the supporting member projections and undercuts were obtained, the insertion of the heater coils would be made very difficult.

Thus, the object of the invention is to provide a radiant heater, as well as a method and apparatus for the manufacture thereof, making possible a reliable fixing with limited expenditure of energy and without additional aids such as putty, cement, etc.

The object is achieved by deforming the support and/or the heating coils during or after insertion of the coils. An apparatus for performing such a method may comprise a plate-like working surface having projections or ribs which can be pressed against the heating coils, deforming parts of the support and/or the coils. A radiant electrical heater so manufactured has deformations in the slots which engage partially around the heating coils.

As a result of these measures the heater coils are secured in the slot area by penetrating the supporting member material. Fixing thereof takes place at the time of introducing the heater coils or following this operation and requires little extra time. The tools used for pressing in and/or compressing enable these working operations to be largely integrated into the coil insertion process.

The fixing can take place by pressing the heater coils into the slots of a shaped or moulded article, which is slightly undersized, compared with the heater coils. Optionally accompanied by slight deformation of the heater coil cross-section, the coils are easily pressed into the slot side walls and in this way secured. It is also possible to press the heating coils into the bottom of the slot, particularly into projections provided therein.

It is also advantageously possible, during the insertion of the heater coils in matching slots, to change the coil cross-section, e.g. from circular to oval by pressing from above, the narrow sides of the resulting oval being pressed into the slot side walls. After inserting the heater coils in matching slots it is also possible to press the webs left between the slots, i.e. in the vicinity of the slot side walls and slightly above the coils, in such a way that a portion which engages over the coils is formed.

Here again the heater coils can be pressed into the slot side wall.

In these embodiments pressing in can take place in the fully hardened state of the supporting member made from an insulating ceramic or fibrous material. However, it is also possible for pressing in or compression to take place before the supporting member is completely hardened, e.g. by baking, firing or drying. In this case the heater coils can be pressed in with very limited resistance, so that this method is also suitable for very thin coils. However, it is also possible to place the heater coils in matching slots of the not yet completely hardened and still moist supporting member, after which the curing and/or firing process takes place.

Shrinkage of the supporting member material also leads to a reduction of the slot dimensions, so that the coil elements are pressed into the wall.

It is fundamentally possible in all embodiments to bring about fixing by penetration into the slot walls over the entire length of the heater coils. However, by providing corresponding projections and recesses in the slot walls it is possible for fixing to take place zonally at certain longitudinal intervals if, e.g. due to considerable wire thickness, there is an adequate stability of the heater coils for fixing to be rendered superfluous in the gaps.

The invention is described in greater detail hereinafter relative to non-limitative embodiments and with reference to the attached drawings, wherein.

FIGS. 4 and 5, 6 and 7, and 8 and 9 are in each case two manufacturing stages of further embodiments.

Figure 1:
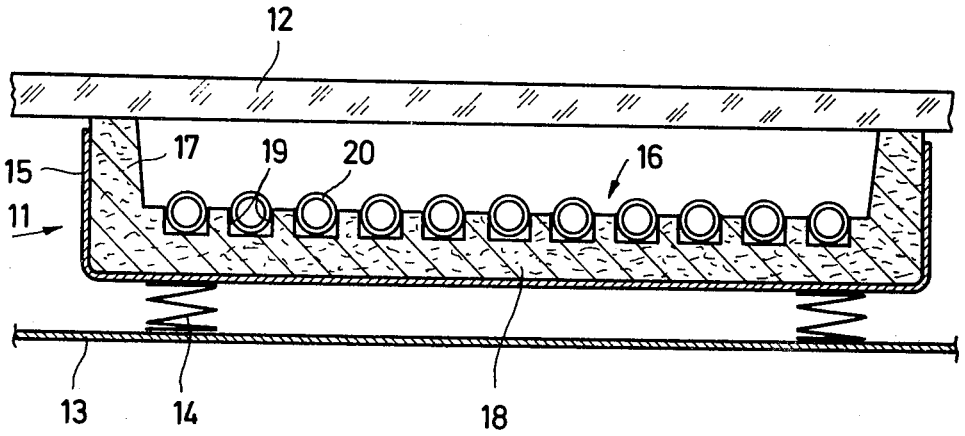
FIG. 1 is a diagrammatic section through a radiant heater and part of a glass ceramic hotplate.

FIG. 1 shows a radiant heater 11 arranged below a glass ceramic plate 12, which forms the cooking surface of a cooker. The radiant heater 11 is supported by springs 14 on a support structure 13, which can for example comprise a sheet metal depression. It serves to heat cooking vessels placed on the glass ceramic plate 12 by means of radiation, which partly penetrates and heats the glass ceramic plate.

Radiant heater 11 comprises a normally circular flat, sheet metal dish-like supporting member 15 in which is placed a support 16 made from an electrically and thermally insulating material. It can be made from a ceramic insulating material or such a material comprising inorganic fibres. Support 16 is also shaped like a flat, circular dish with a substantially flat base 18 and an upright edge 17. Edge 17 is pressed by means of springs 14 against the bottom of the glass ceramic plate 12.

In this embodiment support 16 has spirally arranged slots 19, in which are placed electrical heating resistors in the form of heater coils 20. Their arrangement and fixing in the slots are apparent from the drawings. The heating resistors are connected by means of a switch or regulator to the domestic mains.

Figure 2:
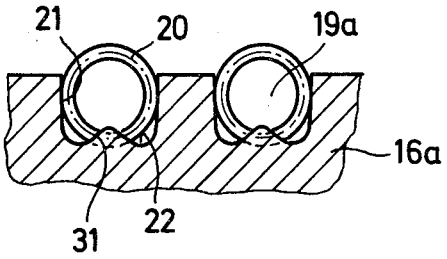
FIG. 2 is a detailed section through an alternative embodiment.

FIG. 2 shows in detail the arrangement of the heater coils 20 in the slots. In this embodiment a heater coil with a circular coil cross-section is placed in a slot, whose width corresponds to the external diameter of the coil, while the depth is less than the coil diameter. Projections 31 are centrally arranged on the bottom 22 of slot 19*a* and said projections can either comprise a rib running in the longitudinal direction of the slot or individual projections on the bottom of the slot. The heater coils are pressed into the slot in such a way that they engage on the side walls thereof and are consequently laterally well guided, but penetrate the projections 31. As a result the coil is secured in the lower area and in particular longitudinal displacements of the coil in the slot are prevented. Thus, the projections are shaped in such a way that a tooth system is formed between them and the coil. Besides the securing in the longitudinal direction of the slot, the support 16*a* is deformed in the vicinity of the projections in such a way that security is provided against falling out at the top, which is advantageous but not as important as securing in the longitudinal direction.

Figure 3:
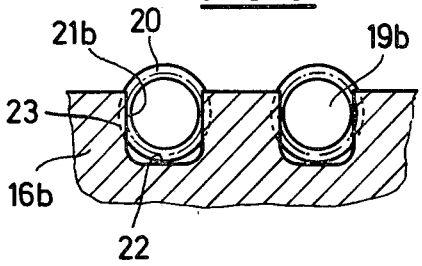
FIG. 3 is a detailed section through still another embodiment.
Figure 4:
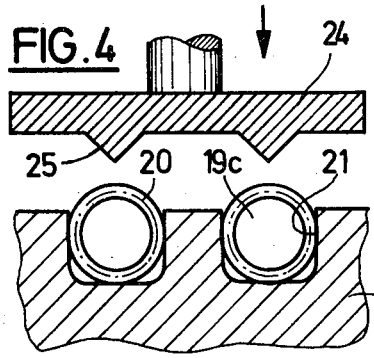

The embodiment of FIG. 3 has slots 19*b*, which are somewhat narrower than the external diameter of the heater coils. The slot bottom 22*b* is flat. On pressing in heater coils 20, they are laterally pressed into the slot side walls 21*b* and as a result impressions 23 are formed there, which once again bring about a very good fixing in the longitudinal direction of the slot. Once again the slot depth is less than the external diameter of the coil, so that the upper coil portion projects over the support 16*b* providing good radiation characteristics in this area. Preferably the slot is somewhat deeper than half the diameter of the heater coil, so that the widest point of the coil is located in the vicinity of impressions 23.

FIG. 24 shows support 16*c* is another embodiment after inserting the heater coils 20, but before the latter have been finally secured. The heater coils 20 are placed in a slot 19*c*, whose width correpsonds to the external diameter of the coils, having on insertion a circular cross-section and a depth between half and the complete coil diameter. The coils are pressed into engagement with the support by means of a tool 24. Tool 24 is shaped like a plate with downwardly projecting and in the embodiment shown triangular ribs 25, which pass longitudinally centrally over the slots 19*c*.

Figure 5:
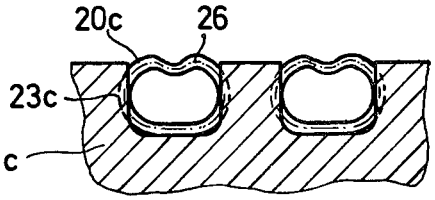

As is apparent from FIG. 5 as a result the heater coils are given a shape like a rounded letter B, lying on its back, the outer coil portion 26 of the deformed coils 20*c* located on the open side of the slot having an impression formed therein. As a result of this deformation the overall shape of the coils is widened and as a result the coils are embedded in the side walls 21 of slot 19*c* where impressions 23*c* are formed which, as in the embodiment of FIG. 3, serve to secure the heater coils. The cross-sectionally triangular ribs 25 can be replaced by ribs with any other basic shape, so that in each case the most favourable coil shapes from the fixing and radiation standpoints are obtained, e.g. also a flat oval. The inward curvature in portion 26 has the advantage that a larger part of the heater coils are disposed in the upper part of the slot which directly faces the glass ceramic plate.

Figure 6:
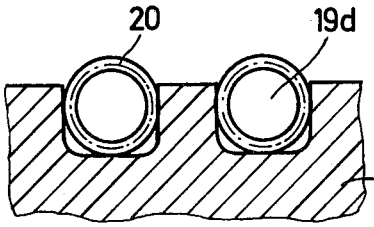

FIG. 6 also shows a support 16 prior to the fixing thereof. The slots 19*d* correspond to those of FIG. 4, but support 16*d* in FIG. 6 although made from the ceramic or fibrous material has not yet been dried, baked or fired to give it its final hardness. In FIG. 6 the heater coils 20 are fitted without impressions in slots 19*d*.

Figure 7:
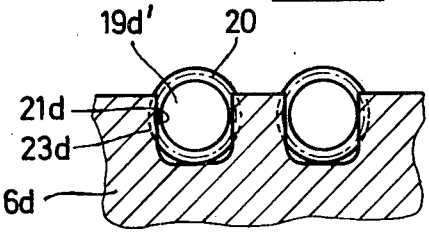

FIG. 7 shows the same support 16*d* after drying and/or firing. During firing shrinkage occurs in the support material, i.e. the support contracts and the slots become narrower. As a result, the dimensions of slots 19*d* of FIG. 6 are reduced to those of slot 19*d'* of FIG. 7. Thus, the heater coils whose dimensions have not been influenced by the curing press into the slot side walls 21*d*, where they form impressions 23*d*, having the same action as in FIG. 3 and 5. As in FIG. 3 there can be slight deformations of the heater coils due to the lateral pressing in, but which, particularly in FIG. 3 can be prevented by a corresponding support during the pressing in.

Figure 8:
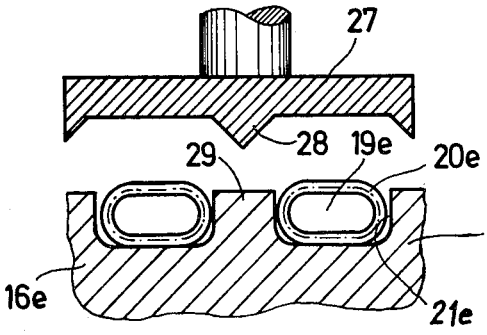
Figure 9:
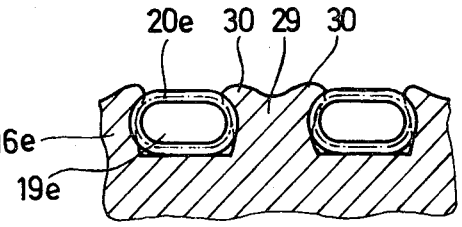

FIG. 8 also shows a production stage of a support 16*e* in which the slots 19*e* are much wider than they are deep, so that it is possible to fit coils 20*e* therein with a flat oval coil cross-section. After inserting the coils, a tool 27 having on its bottom triangular projections 28 arranged centrally over the webs 29, is made to act on said webs, so that they move apart in the manner of a rivet head 30 (FIG. 9) and therefore secure the heater coils 20*e*, whose shape has remained substantially unchanged. Besides bringing about a longitudinally securing by an inward movement of side walls 21*e*, the rivet head-like projections 30 very satisfactorily prevent the coils 20*e* from dropping out. The deformation in FIGS. 8 and 9 can take place in the already cured state or in the wet state, and in the latter case shrinkage assists the fixing process (according to FIGS. 6 and 7).

The fixing processes according to the individually described embodiments are particularly advantageous when combined, particularly when it is a question of fixing very thin wires which are very critical regarding the creep effect. However, with relatively thick wires fixing causes less problems and, for example, it is possible to partly omit the partitions between the slots or alternatively they only need be zonally provided. As a result the heat transfer conditions are improved. Particularly in the case of the embodiment of FIGS. 8 and 9 the deformations 30 need only be zonally provided for thick wires. The depth of the impressions of the heater coils in the slot walls formed by the base and the side walls is dependent on the wire winding diameter and the specific loading of the heated surface, as well as the wire thickness. In the embodiments, the heater coils are also protected against tilting over. This could occur if the wire forming the coils lost sufficient strength at high temperatures for the individual turns of the coil to laterally drop on to one another when not supported.

In the choice of the individual embodiments for carrying out fixing account must also be taken of the nature of the moulded or shaped article. Thus, for example, in the case of the fixing types carried out in the fully cured state a relatively soft shaped article made from fibrous material is preferred, whereas with the embodiment of FIGS. 6 and 7 perference is given to a ceramic material which is hard after firing. The heater coils can be inserted in the predried or prehardened support, which has not yet been thoroughly hardened.

We claim:

1. A method for manufacturing a radiant electrical heater, wherein a support is made from an electrically and thermally insulating material and slots are formed therein for receiving helical heating resistor coils, comprising the further step of deforming at least one of the support and the heater coils, while the support is in a prehardened condition, whereby portions of the support will at least partially surround portions of the heater coils for securing the heater coils in the slots.

2. A method according to claim 1, wherein the support is deformed by pressing the heater coils in the slots, embedding the at least partially surrounded portions.

3. A method according to claims 1 or 2, wherein deformation takes place through shrinkage of the support which surrounds portions of the heating coils during the hardening.

4. A method according to claims 1 or 2, comprising the step of modifying the cross-section of the heater coils after the insertion in the slots.

5. A method according to claim 4, wherein the heater coils are inserted with a circular coil cross-section and deformed by pressing from the outside of the slot.

6. A method according to claim 1, wherein the heater coils are pressed into parts of walls of the slots.

7. A method according to claim 6, wherein the parts of the slots walls into which the heater coils are pressed are longitudinally spaced from one another along the slot.

8. A method according to claim 4, wherein at least following deformation the coil cross-section is oval, the minor axis of the oval being aligned with the thermal radiation direction.

9. A method according to claim 1, wherein adjacent sections of slots define webs therebetween and the deformation of the support is brought about by compressing at least part of the webs.

* * * * *

UNITED STATES PATENT AND TRADEMARK OFFICE

CERTIFICATE OF CORRECTION

PATENT NO. : 4,380,116

DATED : April 19, 1983

INVENTOR(S) : Gerhard Gossler and Eugen Wilde

It is certified that error appears in the above-identified patent and that said Letters Patent are hereby corrected as shown below:

Column 3, line 28, delete "24" and insert --4--.
Column 3, line 28, delete "is" and insert --in--.
Column 3, line 42, between "slot" and "having" insert --and--.
Column 4, line 3, delete "FIG." and insert --FIGS.--.
Column 4, line 17, delete "longitudinally" and insert --longitudinal--.
Column 4, line 50, delete "perference" and insert --preference--.
Column 5, line 12, delete "slots" and insert --slot--.

Signed and Sealed this

*First* Day of *January 1985*

[SEAL]

*Attest:*

GERALD J. MOSSINGHOFF

*Attesting Officer*

*Commissioner of Patents and Trademarks*